US007722301B2

(12) United States Patent
Rosenblum

(10) Patent No.: US 7,722,301 B2
(45) Date of Patent: May 25, 2010

(54) DEVICE FOR ASSISTING IN NECK EXERCISES

(76) Inventor: Jeffrey Lee Rosenblum, 1841 Horseshoe Trail, Chester Springs, PA (US) 19425

( * ) Notice: Subject to any disclaimer, the term of this patent is extended or adjusted under 35 U.S.C. 154(b) by 0 days.

(21) Appl. No.: 12/214,341

(22) Filed: Jun. 18, 2008

(65) Prior Publication Data

US 2009/0318268 A1 Dec. 24, 2009

(51) Int. Cl.

| | |
|---|---|
| ***A63B 23/025*** | (2006.01) |
| ***A63B 21/002*** | (2006.01) |
| ***A63B 21/068*** | (2006.01) |
| ***A63B 21/012*** | (2006.01) |
| ***A63B 21/00*** | (2006.01) |
| ***A63B 71/10*** | (2006.01) |

(52) U.S. Cl. ..... 410/10; 482/91; 482/96; 482/114; 482/131; 2/425

(58) Field of Classification Search ..... 482/10, 482/114, 124, 139, 91, 95, 96, 131; 602/17, 602/18, 32–36; 434/250; 601/39; 2/410, 2/422, 425, 10, 421

See application file for complete search history.

(56) References Cited

U.S. PATENT DOCUMENTS

| | | | | | |
|---|---|---|---|---|---|
| 712,827 | A * | 11/1902 | Maxwell et al. | ..... | 482/124 |
| 1,530,748 | A * | 3/1925 | Alastalo | ..... | 482/10 |
| 2,051,366 | A * | 8/1936 | Catron | ..... | 482/10 |
| 3,174,155 | A * | 3/1965 | Pitman | ..... | 2/411 |
| 3,815,152 | A * | 6/1974 | Bednarczuk et al. | ..... | 2/9 |
| 4,060,855 | A * | 12/1977 | Rappleyea | ..... | 2/413 |
| 4,326,303 | A * | 4/1982 | Rappleyea | ..... | 2/411 |
| 4,660,230 | A * | 4/1987 | Mayling | ..... | 2/413 |
| 4,832,333 | A * | 5/1989 | Lockett | ..... | 482/10 |
| 4,937,888 | A * | 7/1990 | Straus | ..... | 2/411 |
| 5,505,677 | A * | 4/1996 | Hinds | ..... | 482/10 |
| 5,732,414 | A * | 3/1998 | Monica | ..... | 2/425 |
| 6,272,692 | B1 * | 8/2001 | Abraham | ..... | 2/411 |
| 6,314,586 | B1 * | 11/2001 | Duguid | ..... | 2/411 |
| 6,499,149 | B2 * | 12/2002 | Ashline | ..... | 2/468 |
| 6,813,782 | B2 * | 11/2004 | Kintzi et al. | ..... | 2/421 |

(Continued)

OTHER PUBLICATIONS http://en.wikipedia.org/wiki/File:120843583_e22b153125_o.jpg.*

(Continued)

*Primary Examiner*—Loan H Thanh
*Assistant Examiner*—Allana Lewin
(74) *Attorney, Agent, or Firm*—Drinker Biddle & Reath LLP

(57) ABSTRACT

A headgear device for assisting a user in performing bridge exercises to strengthen the muscles of the neck, and exercises performed using the device. The headgear outer surface has an area of low-friction material to allow the headgear to slide on an exercise surface while the user's head supports a portion of his body weight in the bridge position. This allows the user to introduce dynamic resistance into the exercise by moving around on the surface. One or more straps connectable to the user's arms and/or legs can be used to provide stability and/or resistance during the exercise. A friction pad adapted to be removably attached to the outer surface of the headgear can be used to provide resistance to the headgear sliding.

4 Claims, 6 Drawing Sheets

U.S. PATENT DOCUMENTS

| | | | | |
|---|---|---|---|---|
| 6,886,186 | B2 * | 5/2005 | Jansen | 2/422 |
| 6,939,269 | B2 * | 9/2005 | Makofsky | 482/10 |
| 7,189,192 | B2 * | 3/2007 | Edgeton | 482/10 |
| 2004/0025230 | A1 * | 2/2004 | Rainey | 2/422 |
| 2004/0058780 | A1 * | 3/2004 | Edgeton | 482/10 |
| 2004/0068779 | A1 * | 4/2004 | Duffy | 2/422 |
| 2007/0067893 | A1 * | 3/2007 | Mothaffar | 2/421 |

OTHER PUBLICATIONS

The Ultimate Urban Dancers DVD: http://www.urbandancersla.com/intermark/.*

"Helme" and "Headspin Beanie" http://imgres.google.com/imgres?imgurl=http://breakdancingninja.com/images/Breakdancing_Gear/get_started_in_breakdancing_clip_image004.jpg&imgrefurl=http://breakdancingninja.com/get_started_in_breakdancing.html&usg=_FOKnWYplPfdEML49H_ywcBvWA2Q=&h=300&w=261&sz=14&hl=en&start=94&um=1&tbnid=0LUFpZzVNsh-DM:&tbnh=116&tbnw.* http://mvgals.net/gallery/bestof_breakdancing_04/IMG_8834.*

* cited by examiner

DEVICE FOR ASSISTING IN NECK EXERCISES

TECHNICAL FIELD

This invention relates generally to devices for assisting a user to exercise the muscles of the neck, and methods for using the same.

BACKGROUND

The neck is one of the body parts most susceptible to sports-related injuries. Strong, well-developed neck muscles can help protect an athlete's neck and spine against injury, especially in sports such as wrestling, martial arts, and other contact sports. One of the most common neck exercises is called the "wrestler's bridge." It is performed by an athlete lying on his back (supine) on an exercise surface such as a floor or exercise mat, then arching his back and placing the soles of his feet on the surface, while simultaneously supporting the weight of his body with his head, neck, and feet. This uses the weight of the athlete's body as resistance against the muscles of the neck. The wrestler's bridge may also be performed from a prone, or stomach-down, position using the head and feet or knees to support the body. Once in the bridge position, the athlete may change the resistance level and direction by rocking his hips, or by rolling his head in one direction or another to work the muscles of the neck. The bridge is a particularly effective and relatively safe exercise because it uses the athlete's own body weight as resistance, lowering the chance of injury while exercising, and because in the bridge position, the neck is forced to provide stability to the body, providing a more effective workout than that offered by a simple resistance motion in one direction.

There are various mechanical devices intended to assist an athlete in strengthening the neck muscles. These devices may use pulleys, collars, and external weights to apply resistance to the motion of the athlete's neck. Such devices are typically large, expensive, and often work the neck muscles in only one plane of motion. The use of external weights also increases the chance of injury through overexertion during the exercise. Because of this, such devices are typically not suitable for home use, and do not provide a complete workout for all the muscles in the neck. A need exists, therefore, for an easy-to-use and inexpensive device that allows a user to perform a complete workout on the muscles of the neck.

DETAILED DESCRIPTION OF THE DRAWINGS

The drawings of the present invention illustrate various embodiments of the device described and claimed herein, and do not limit the scope of the claims.

Figure 1A:
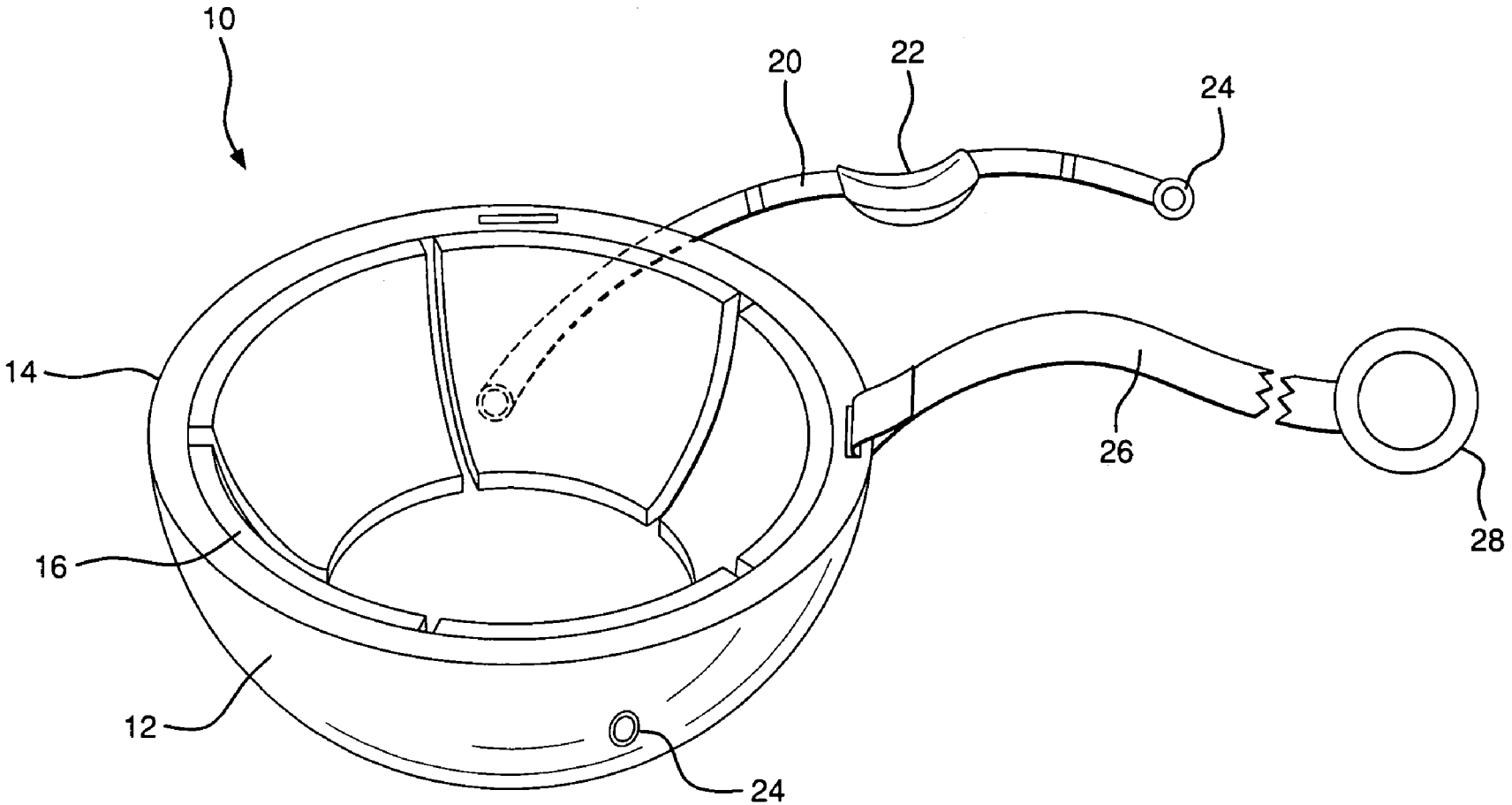
FIG. 1A shows a perspective view of an embodiment of the device described herein.
Figure 1B:
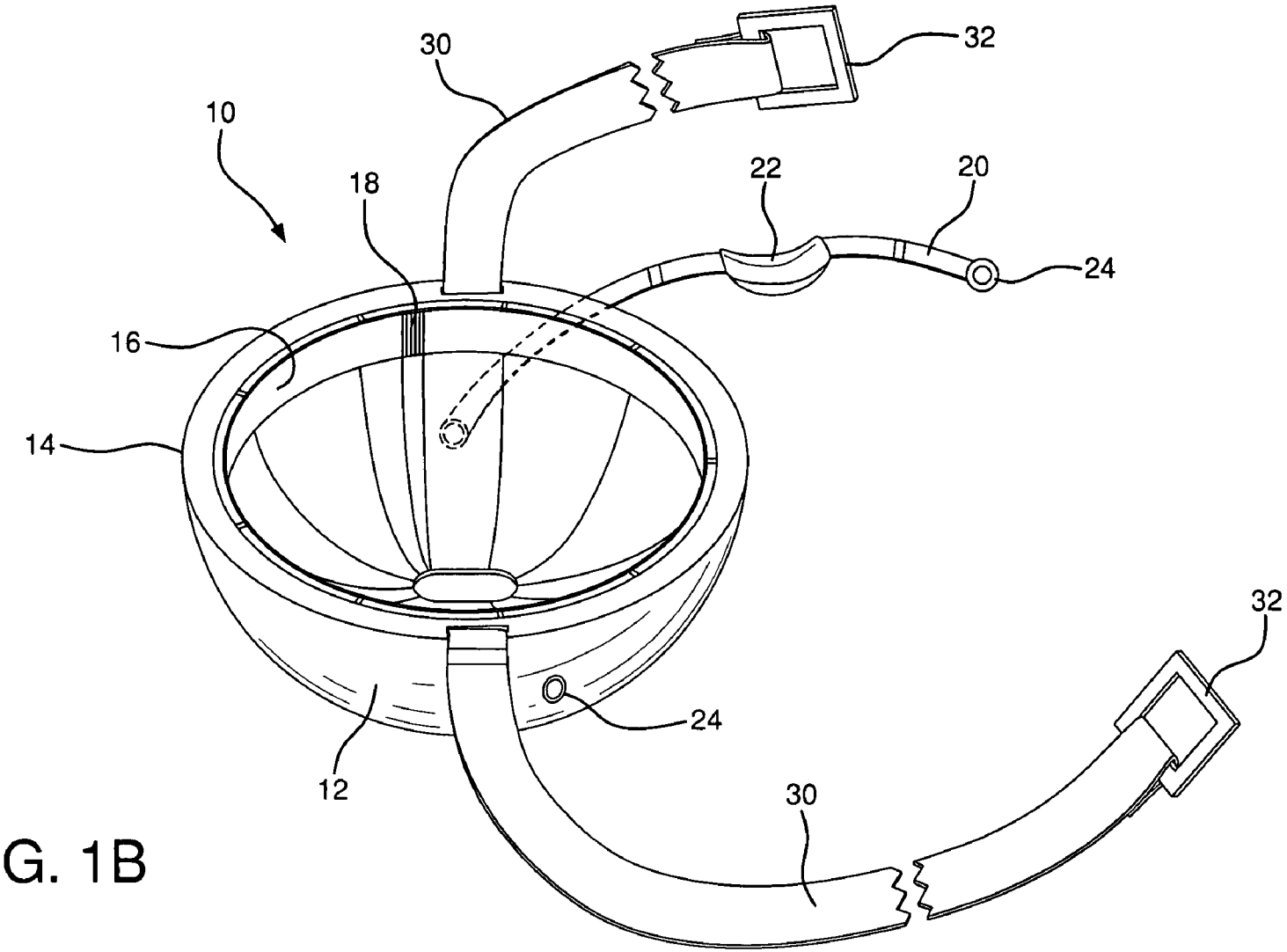
FIG. 1B shows a perspective view of a second embodiment of the device described herein.

Referring to FIGS. 1A and 1B, an embodiment of a device 10 for exercising neck muscles includes a headgear 12 having a shell 14 with a lining 16. The headgear is shaped to fit on a user's head, and the shell has a convex outer surface, preferably free of flat areas, ridges, or corners.

As seen in FIG. 1B, the lining may include an adjustment mechanism 18 to enable the headgear to fit a range of head sizes. Alternatively, the headgear may be size-specific, or the lining may be removable. Removable linings in various sizes could be sold to be inserted into a common shell. This would allow multiple users to share a common shell, as well as providing a way to remove and clean the lining.

As seen in FIGS. 1A and 1B, the headgear may include a chin strap 20, which preferably includes a chin pad 22. The chin strap allows the user to secure the headgear to the user's head, and the chin pad helps properly locate the chin strap and headgear on the user's head, and provides increased comfort. The chin strap is preferably adjustable in length to accommodate multiple users, and one or both ends of the chin strap may be removably attached to the headgear by means of fasteners 24.

The device shown in FIG. 1A further includes a stability strap 26, which can be used to connect the headgear to a user's ankle, leg, or foot by an attachment mechanism 28, which is preferably a loop or band that encircles an ankle, leg, or foot of the user. The attachment loop is preferably adjustable in size. The strap 26 may be fixed length, adjustable, or elastic. This strap provides stability to the headgear, helping the headgear to remain in place when the user moves. The strap 26 may also be used to increase the resistance on the user's neck.

Figure 2A:
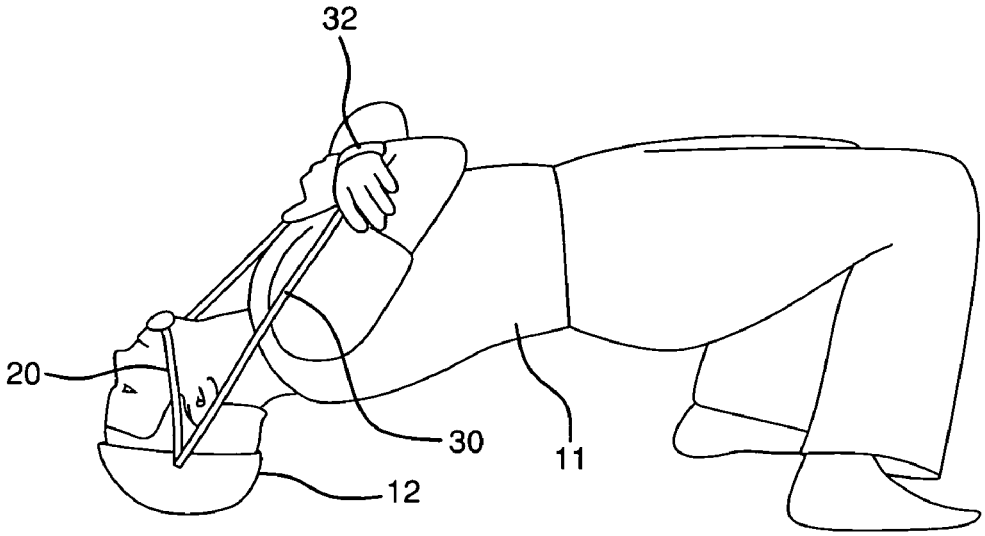
FIG. 2A shows an athlete in a typical "wrestler's bridge" position, using an embodiment of the device of FIG. 1.
Figure 2B:
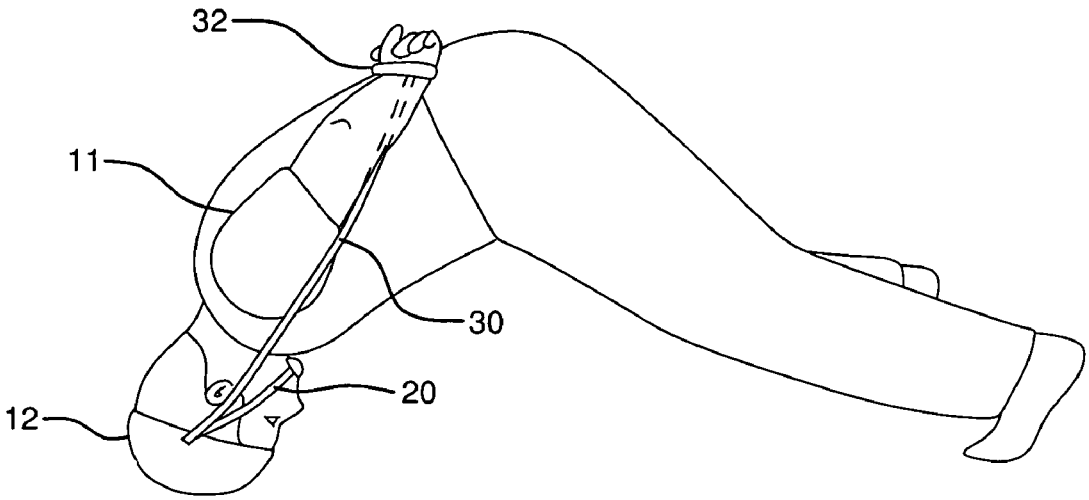
FIG. 2B shows an athlete in an alternative "wrestler's bridge" position, using an embodiment of the device of FIG. 1.
Figure 2C:
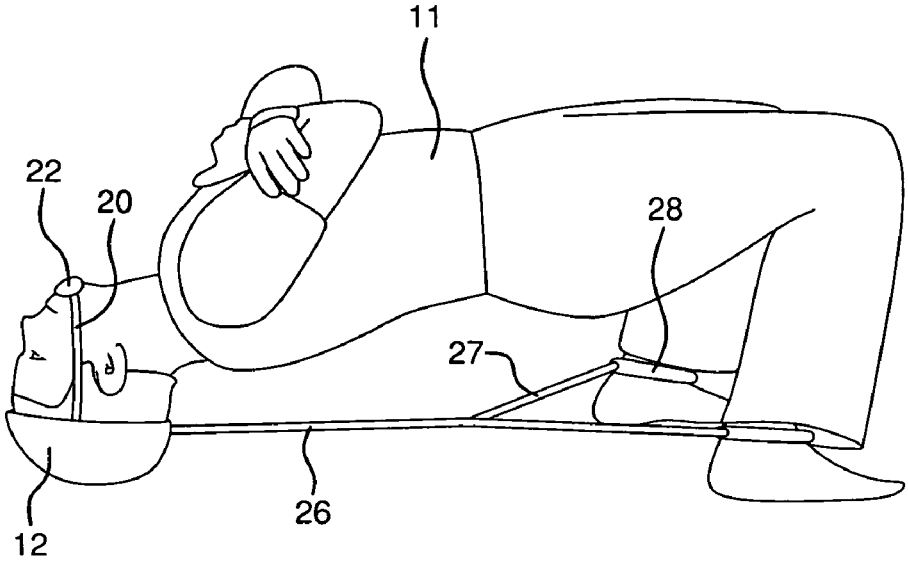
FIG. 2C shows an athlete in a typical "wrestler's bridge" position, using a second embodiment of the device of FIG. 1.
Figure 2D:
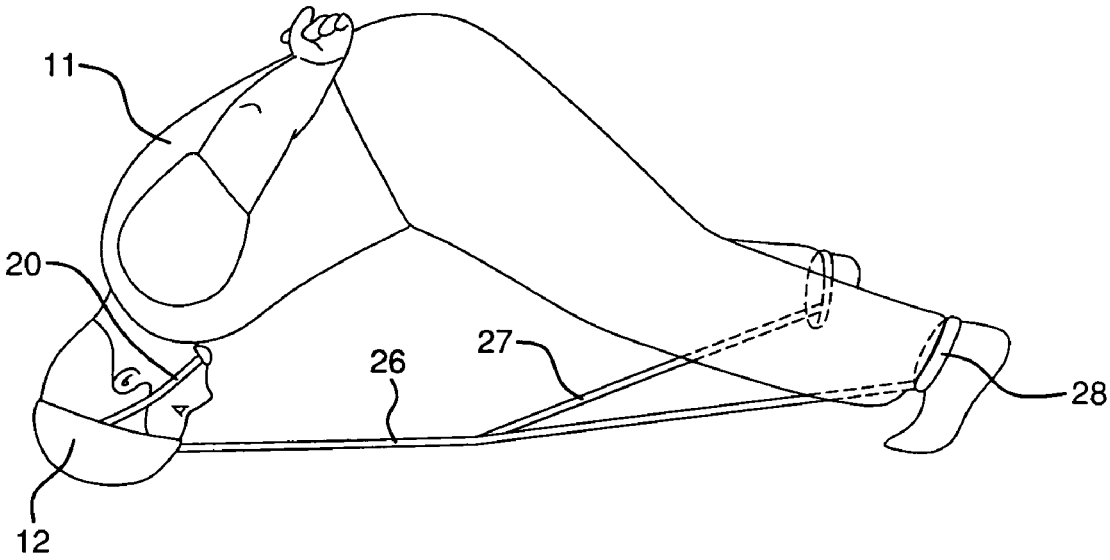
FIG. 2D shows an athlete in an alternative "wrestler's bridge" position, using a second embodiment of the device described herein.

Alternatively, the strap may form a Y-shape with prong ends 27 that can be connected to each of the user's ankle, leg, or foot, as shown in FIGS. 2C and 2D.

Figure 2E:
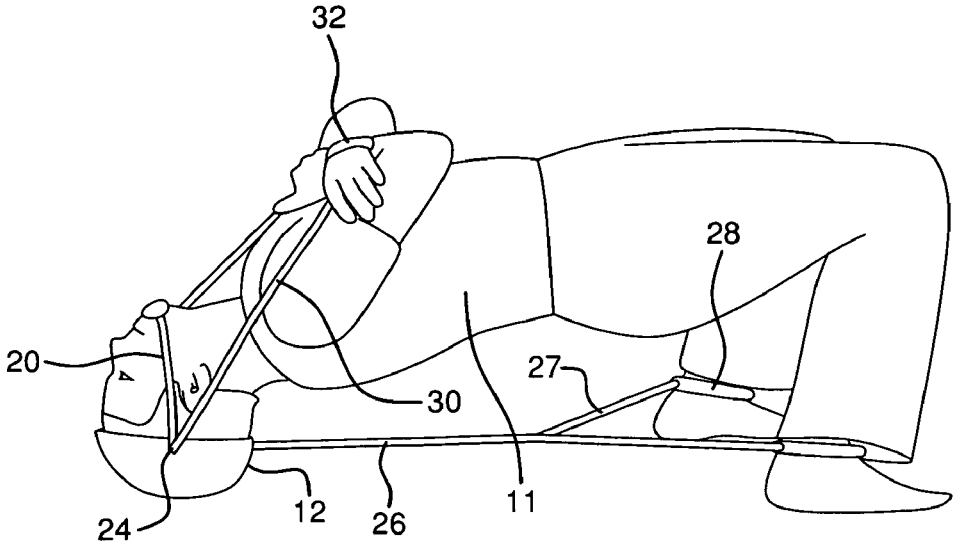
FIG. 2E shows an athlete in a typical "wrestler's bridge" position, using a third embodiment of the device of FIG. 1.
Figure 2F:
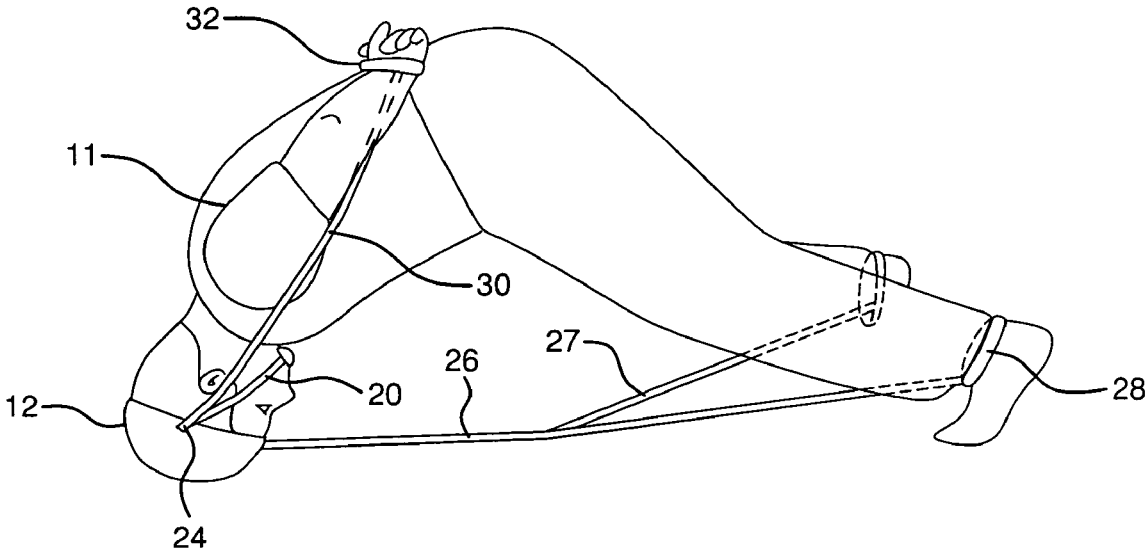
FIG. 2F shows an athlete in an alternative "wrestler's bridge" position, using a third embodiment of the device described herein.

The alternative embodiment shown in FIG. 1B includes two stability straps 30, each of which also include attachment mechanism 32 such as an adjustable size loop to fit around the user's arms, wrists, or hands. Like strap 26, these two straps may be fixed length, adjustable, or elastic. Alternatively, a single headgear may feature multiple stability straps 26 and 30, as shown in FIGS. 2E and 2F.

The shell 14 is constructed of a low-friction material that not only protects the user's head, but allows the headgear to easily slide and pivot on an exercise surface. Suitable low-friction materials include polyoxymethylene, homopolymer acetal, co-polyester, high-density and ultrahigh density polyethylene, ultra high molecular weight polyethylene (UHMWPE) or, most preferably, polytetraflouroethylene (PTFE/Teflon). Those of ordinary skill in the art will realize that the low-friction material may include any material with a lower coefficient of friction than the user's head. The lining 16 is preferably constructed of a washable, compressible material that cushions the user's head. Suitable materials include polyurethane or ethylene vinyl acetate (EVA) foam; however, persons of ordinary skill will realize that any number of compressible materials may be used.

Since the purpose of the low-friction material is to allow the headgear to easily slide or pivot without binding on an exercise mat, the shell could be constructed in sections, with the low-friction section on the crown and sides likely to contact the mat, while the other section or sections can be a different material. For ease in molding, however, the shell will likely be molded as a unit.

Figure 3:
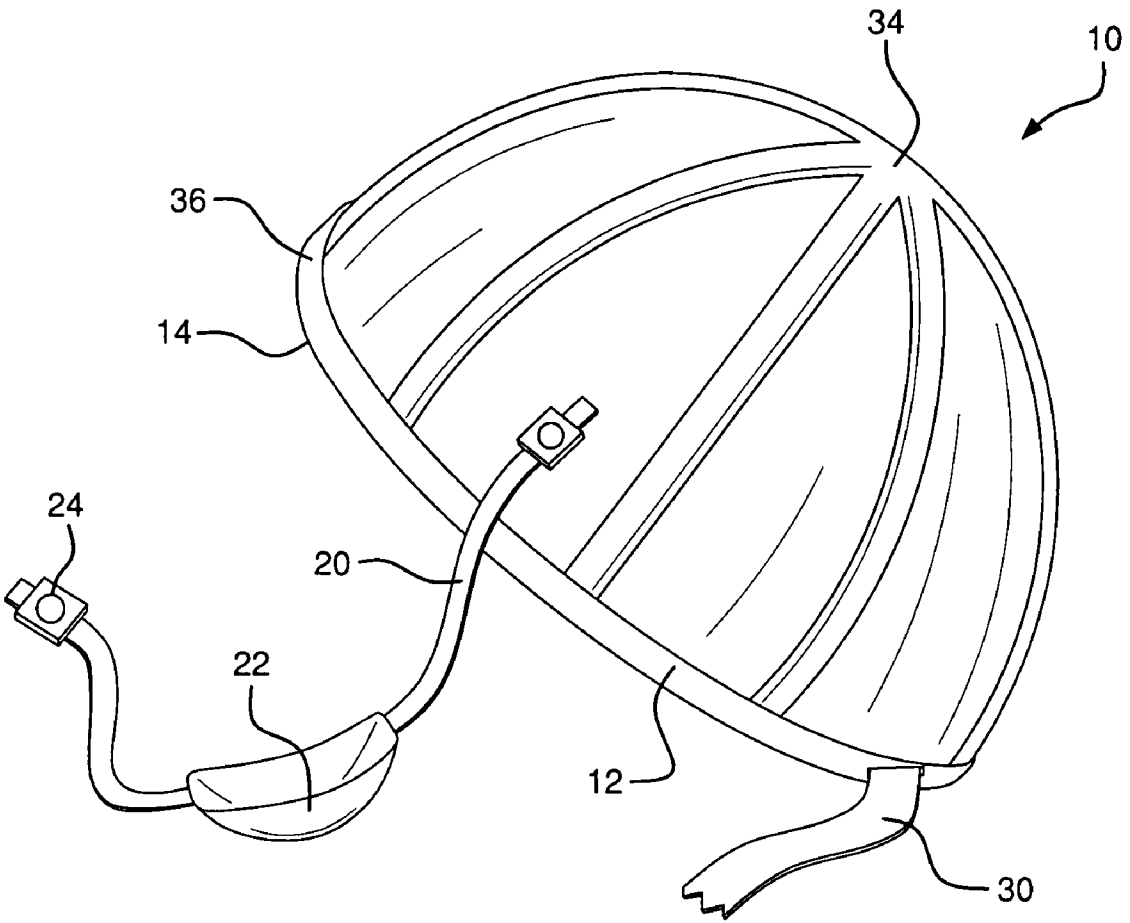
FIG. 3 shows another embodiment of the device of the present invention.

There may be certain exercises when the user does not want the low-friction feature and instead wants the headgear to resist movement across the mat. For that situation, the headgear may further include a removable friction pad 34 attached to the outer surface of the shell. As shown in FIG. 3, the friction pad 34 could be in the form of a web that can be stretched over the shell 14. The friction pad is preferably made from rubber, but may be made from any material that will generate friction between the shell and the exercise surface while conforming to the shape of the shell. The friction pad may be secured to the headgear by means of a circumferential band 36, or by other removable means, such as suction cups (not shown).

As shown in FIGS. 2A-2D, an athlete 11 may use the device 10 to perform neck exercises while in a position known as a "wrestler's bridge." The user first secures the device to his head, preferably by means of the chin strap 20. Depending on the configuration of the device and his intended movements, the user may then attach the stability straps 26 or 30 to his limbs by means of attachment mechanisms 28 and 32, respectively. As shown in FIGS. 2A and 2C, the user may assume a supine position, and then raise his body off the ground, entering the bridge position by supporting his weight on his feet and head. Maintaining this bridge position requires resistance by the sternocleidomastoid, trapezius, and platysma muscles in the neck. Alternatively, as shown in FIGS. 2B and 2D, the user may assume a prone position before moving into the bridge position. This method also exercises the muscles of the neck. The longer the user is able to maintain the bridge position, the more effective and demanding the exercise becomes. The lining of the headgear is compressible, so that muscle fatigue rather that surface discomfort is the limiting factor, and therefore the user is able to maintain the bridge longer.

From either position, the user may adjust his body arc to vary the amount or direction of resistance required from the neck muscles. The stability straps can be used to increase or reduce the force applied through the headgear to the neck muscles.

The low-friction material of the shell allows the user to add a dynamic component to the exercise. Through the increased ability to slide and pivot on the mat, the user can incorporate footwork and rapid changes of body angle into the bridge exercise. This dynamic element is more realistic of wrestling moves, and provides an increased range of motion, thus increasing the effectiveness of the exercise over the isometric resistance produced in maintaining a stationary bridge. The dynamic nature of the exercise also introduces an aerobic element to the exercise, allowing an athlete to improve his aerobic conditioning while performing the exercise.

I claim:

1. A method of exercising a neck muscle of a user, the method comprising the steps of:

securing a headgear to the user's head, the headgear having an inner surface and an outer surface, the inner surface shaped to substantially conform to a user's head, wherein the outer surface comprises an area of low-friction polymer material that is substantially smooth and uniform to allow the headgear to slide on an exercise surface, a flexible strap having a first end attached to the headgear and a second end adapted to be engaged by a limb of the user, and a friction pad adapted to be removably attached to the outer surface of the headgear to provide resistance to the headgear sliding on the exercise surface;

assuming a prone or supine position on an exercise surface;

supporting substantially all of the user's body weight with only the user's limbs and the user's head, with the headgear contacting the surface between the user's head and the exercise surface.

2. The method of claim 1, including the further step of the user moving around on the surface, causing the headgear to slide along the surface.

3. A method of exercising a neck muscle of a user, the method comprising the steps of:

securing a headgear to the user's head, the headgear including an inner surface and an outer surface, the inner surface shaped to substantially conform to a user's head, wherein the outer surface comprises an area of low-friction polymer material to allow the headgear to slide on an exercise surface while the user's head supports a portion of his body weight, and a flexible strap having a first end attached to the headgear and a second end adapted to be engaged by a limb of the user;

engaging a limb of the user to the second end of the strap;

assuming a prone or supine position on an exercise surface;

supporting substantially all of the user's body weight with only the user's limbs and the user's head, with the headgear contacting the surface between the user's head and the exercise surface.

4. The method of claim 3, including the further step of the user moving around on the surface, causing the headgear to slide along the surface.

* * * * *